US005286023A

United States Patent [19]

Wood

[11] Patent Number: 5,286,023

[45] Date of Patent: Feb. 15, 1994

[54] VIDEO LOTTERY GAME

[75] Inventor: Michael W. Wood, Denham Springs, La.

[73] Assignee: BKE, Incorporated, Chicago, Ill.

[21] Appl. No.: 795,129

[22] Filed: Nov. 20, 1991

[51] Int. Cl.[5] ..... A63F 3/06

[52] U.S. Cl. ..... 273/138 A

[58] Field of Search ..... 273/138 A, 143 R, 85 G; 364/412, 410

[56] References Cited

U.S. PATENT DOCUMENTS

| | | | |
|---|---|---|---|
| 3,759,525 | 9/1973 | Davis | 273/143 R |
| 4,312,508 | 0/0000 | Wood | 273/274 |
| 4,624,459 | 11/1986 | Kaufman | 273/143 R |
| 4,652,998 | 3/1987 | Koza et al. | 364/412 |
| 4,689,742 | 8/1987 | Troy et al. | 364/412 |
| 4,695,053 | 9/1987 | Vazquez, Jr. et al. | 273/143 R |
| 4,743,022 | 5/1988 | Wood | 273/85 CP |
| 4,813,675 | 3/1989 | Greenwood | 273/138 A |
| 4,837,728 | 6/1989 | Barrie et al. | 364/412 |
| 4,842,278 | 6/1989 | Markowicz | 273/138 A |
| 4,871,167 | 10/1989 | Pasierb, Jr. | 273/434 |
| 4,871,171 | 10/1989 | Rivero | 273/138 A |
| 4,991,848 | 2/1991 | Greenwood et al. | 273/143 R |
| 5,106,089 | 4/1992 | Wood | 273/139 |

FOREIGN PATENT DOCUMENTS

| | | | |
|---|---|---|---|
| 2147773 | 5/1985 | United Kingdom | 273/138 A |
| 2148135 | 5/1985 | United Kingdom | 273/138 A |

OTHER PUBLICATIONS

Virginia Lottery Pick 3 and Pick 4, received in the PTO on Jan. 10, 1991.

*Primary Examiner*—Benjamin H. Layno

*Attorney, Agent, or Firm*—Mason, Kolehmainen, Rathburn & Wyss

[57] ABSTRACT

A video lottery game having a video-display and a processor for enabling a player to play and a method of playing a video lottery game are provided. Jackpot prize schedules are calculated and displayed for viewing by the player. Responsive to the displayed jackpot prize schedules, a player's bet is received and displayed. A plurality of objects are randomly selected and are then displayed at a speed responsive to a player selection. Game results are evaluated and displayed responsive to the randomly selected and displayed objects.

14 Claims, 21 Drawing Sheets

VIDEO LOTTERY GAME

BACKGROUND OF THE INVENTION

1. Field of the Invention

The invention relates generally to the field of lottery games, and more particularly to a video lottery game.

2. Description of the Prior Art

Known lottery games generally include instant scratch-off ticket and on-line computerized games. An advantage of instant scratch-off ticket games is that a player knows instantly whether or not he has won a prize. Typically both instant scratch-off tickets and on-line computerized systems provide prize amounts that are paid on a pari-mutual basis. As a result, significantly decreased sales of instant scratch-off tickets can result after it is known that large prizes have been paid.

Many of the on-line computerized system games provide limited excitement for the players due to required waiting for drawings that determine the winning tickets. Further, a lottery agent often is required to operate the lottery terminal.

Video draw poker games often are skill-based games that do not require a lottery agent and can provide instant prize results. For example, a computer video draw poker game is disclosed in U.S. Pat. No. 4,743,022. However, a non-skill game or a game of pure chance is a more suitable lottery game so that the less intelligent player is not penalized.

U.S. Pat. No. 4,652,998 discloses a video gaming system including consumer operated terminals each having a video amusement game display and connected to a central controller which supervises the network of terminals. The consumer operated terminals can be customized for different types of games. The video gaming system includes a prize distribution arrangement with the central controller assigning a minipool to each terminal. The minipool represents a fixed number of game plays and a predetermined number of prizes. Examples of skill and non-skill games are disclosed.

It is desirable to provide a video lottery gaming system and video lottery gaming method that increases player participation and lottery sales.

SUMMARY OF THE INVENTION

Important objects of the present invention are to provide a video lottery game and video lottery gaming method where jackpot prize schedules are displayed for a player before a player's bet is entered; to provide a video lottery game and video lottery gaming method where game objects are displayed at a speed responsive to a player selection; to provide a video lottery game and video lottery gaming method where a player competes against a known paytable rather than other players; to provide a video lottery game and video lottery gaming method where skill of the player is not a factor and to provide a video lottery game and video lottery gaming method that overcome many disadvantages of prior art arrangements.

In brief, the objects and advantages of the present invention are achieved by a video lottery game having a video display and a processor for enabling a player to play, and a method of playing a video lottery game. Jackpot prize schedules are calculated and displayed for viewing by the player. Responsive to the displayed jackpot prize schedules, a player's bet is received and displayed. A plurality of objects are randomly selected and are then displayed at a speed responsive to a player selection. Game results are evaluated and displayed responsive to the randomly selected and displayed objects.

BRIEF DESCRIPTION OF THE DRAWING

The present invention together with the above and other objects and advantages may best be understood from the following detailed description of the embodiment of the invention illustrated in the drawings, wherein.

DETAILED DESCRIPTION OF THE PREFERRED EMBODIMENT

Figure 1:
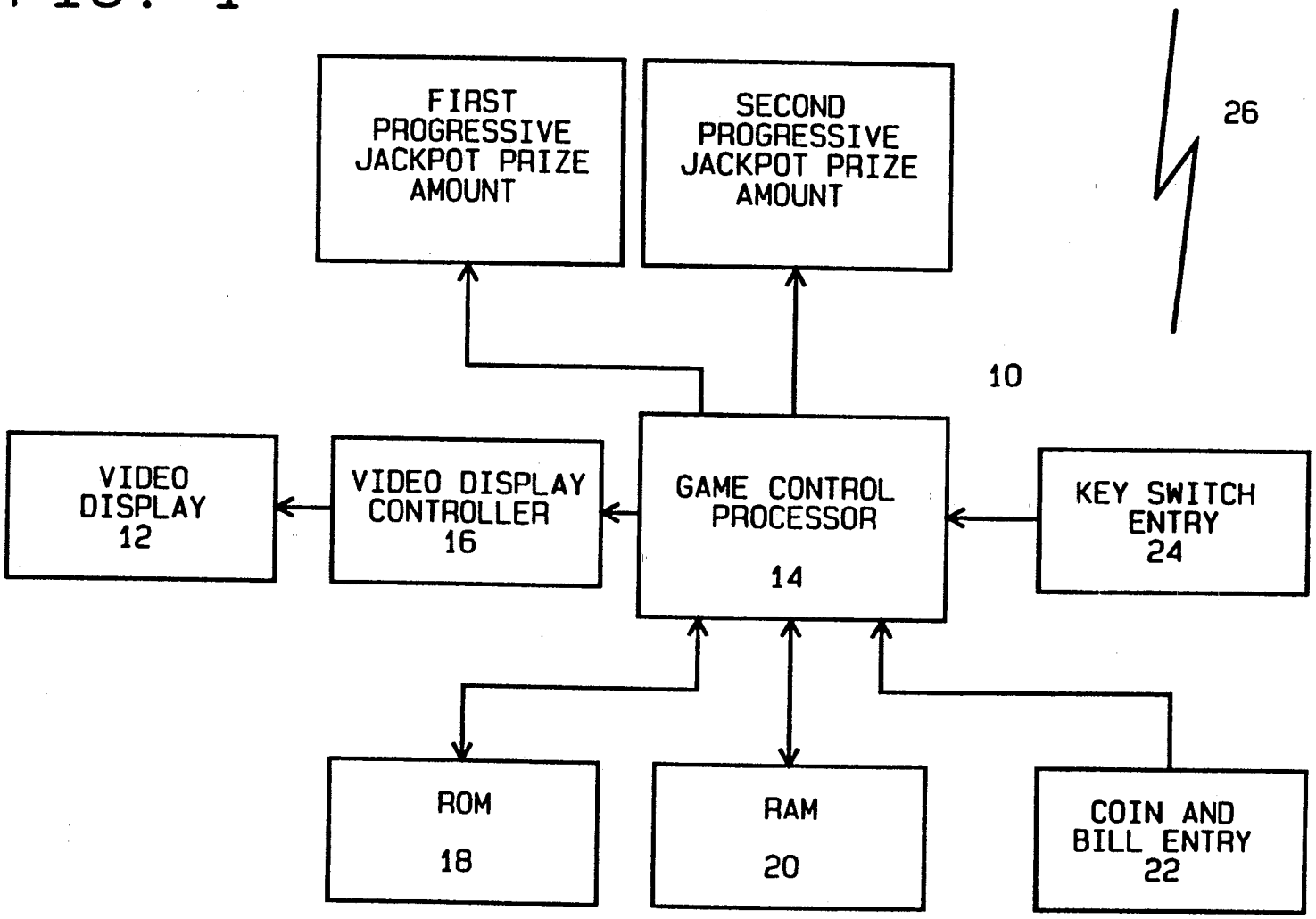
FIG. 1 is a logical block diagram representation of a gaming device according to the invention.

Referring to FIG. I, there is shown a logical block diagram representation of a video lottery gaming device generally designated by the reference character 10. The video lottery gaming device 10 includes a video display 12 for displaying a video lottery game according to the invention. A game control processor 14 operatively controls the video display 12 via a video display controller 16 and is coupled to associated memory devices, such as a read only memory (ROM) 18 for storing program and game functions and a random access memory (RAM) 20 for storing game parameter data. A coin and bill entry device 22 and a keyswitch entry device 24 provide player input signals to the game control processor 14. Gaming device 10 includes an optional communications link 26 for enabling bidirectional communications between the gaming device 10 and a central controller (not shown).

A plurality of video lottery gaming devices 10 can be connected to the central controller. Then the central controller can be used to maintain jackpot prize schedules for the entire network of video lottery gaming devices 10. Alternatively, each video lottery gaming device 10 can be adapted for maintaining jackpot prize schedules and for independent operation.

Figure 2:
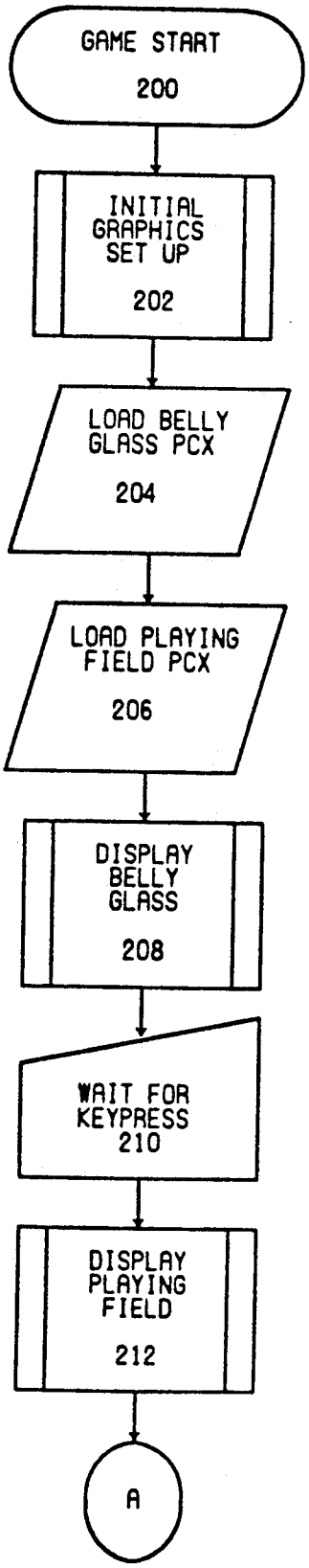
FIGS. 2 through 24 are logical flow diagrams illustrating the logical functions of the gaming device of FIG. 1.

Referring to FIGS. 2–24, there is shown logical flow diagrams illustrating logical functions of the video lottery gaming device 10. Referring initially to FIGS. 2–5, the overall sequential video game steps are illustrated. In FIG. 2, the video lottery game begins indicated at a block 200, initial graphics are set up indicated at a block 202, and belly glass and playing field displays are loaded indicated at blocks 204 and 206. First the belly glass is displayed indicated at a block 208. After a keypress is identified at a block 210, the playing field is displayed at a block 212.

Figure 3:
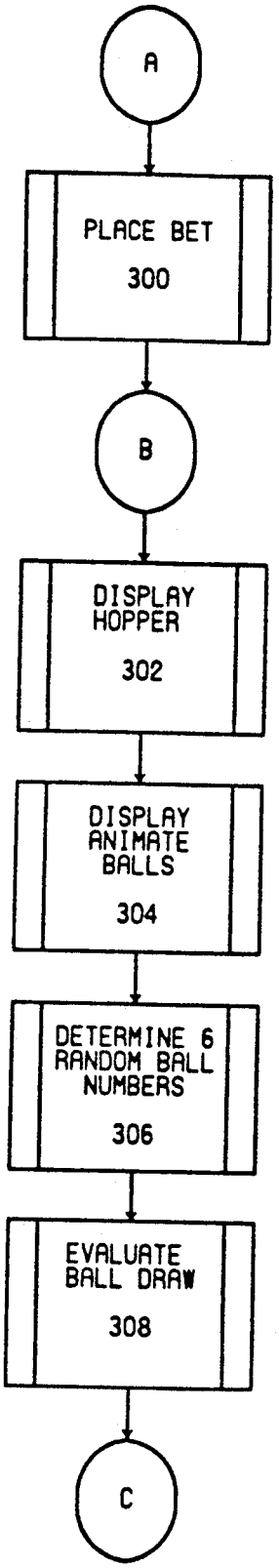

In FIG. 3, a player's bet is received at a block 300 following entry point A. Then an object, such as a ball hopper is displayed at a block 302 following entry point B. Next the game control processor 14 generates a display of five animated balls at a block 304. The game control processor 14 randomly generates six random ball numbers at a block 306. Each ball is randomly selected from a hopper which contains balls having numerical symbols 0 through 9 and multiple colors. The randomly selected numerical symbols are evaluated to identify winning combinations at a block 308.

Figure 4:
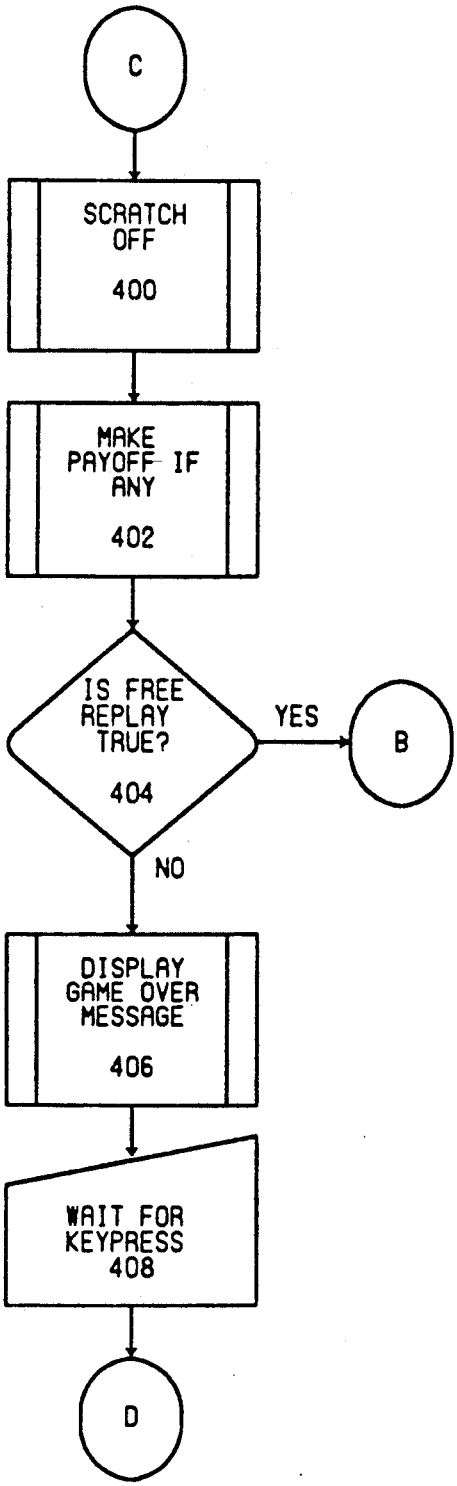

Sequential operations continue following entry point C in FIG. 4. Then at a block 400, the numerical symbols and color of each of the five randomly selected balls are displayed responsive to a player selection or scratch off entry via the keyswitch entry device 24. By the player's selection at the block 400, the player controls the duration of a round of play. Then next payoff for an identified winning combination if any is made at a block 402. A free replay determination is made at a decision block 404. When a free replay is identified at the block 404, then the sequential operations return to entry point B in FIG. 2. Otherwise, the game over message is displayed at a block 406 and the game control processor 14 monitors for a keypress at a block 408.

Figure 5:
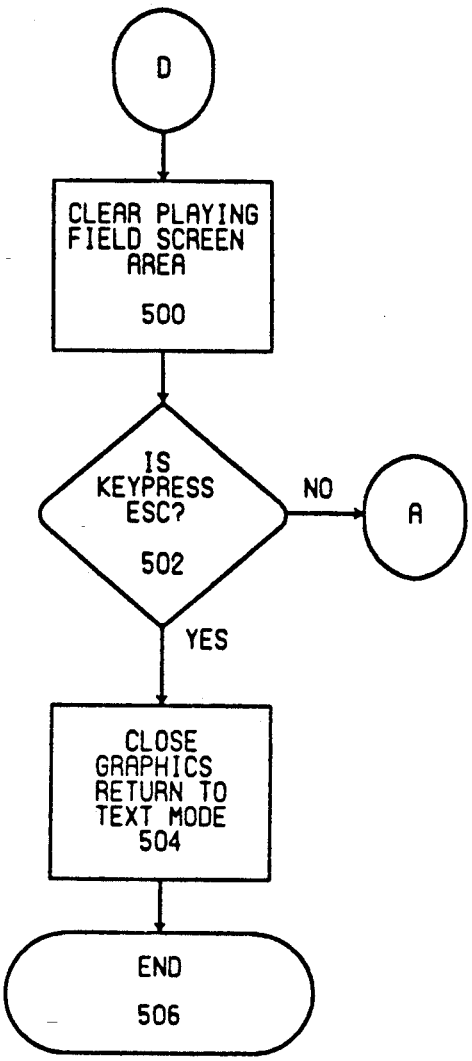

Having reference to FIG. 5, next the playing field screen area of video display 12 is cleared at a block 500 following entry point D. Then a determination of a predefined keypress entry is made at a decision block 502. When the predefined keypress entry is identified, then the operation is returned to the text mode, closing the graphics mode. Otherwise, when the predefined keypress entry is not identified, then the sequential operations are repeated returning to entry point A in FIG. 3.

Figure 6:
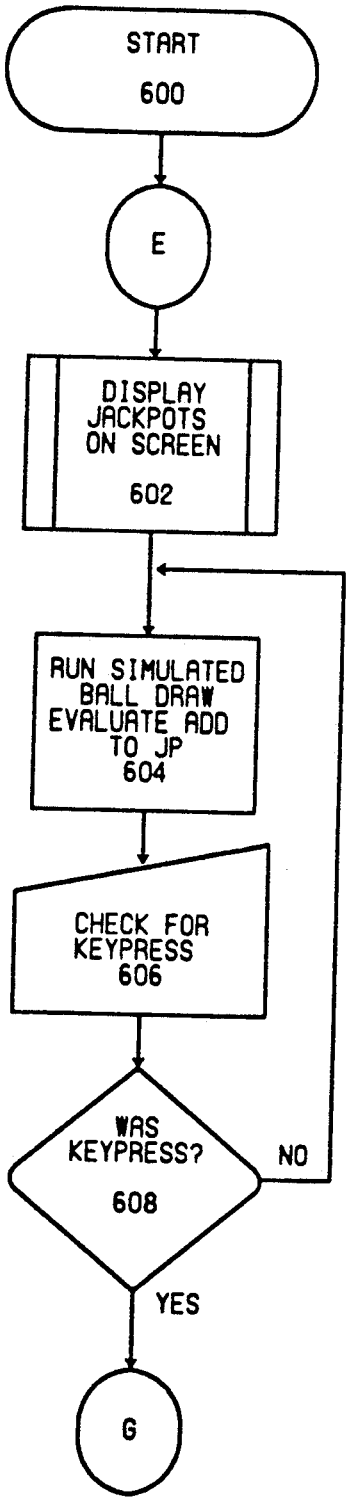
Figure 22:
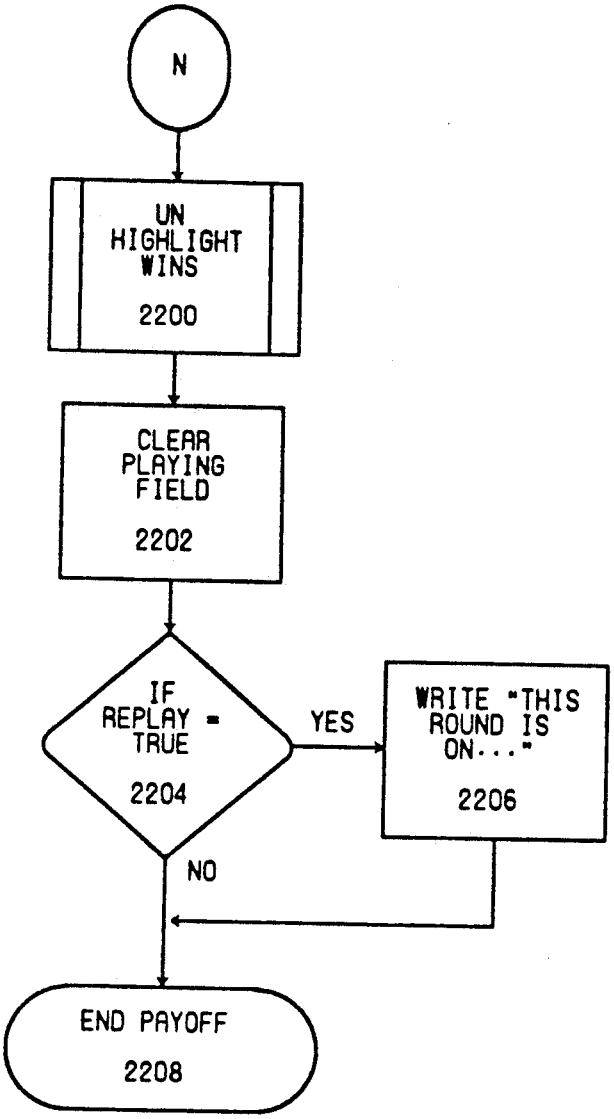
Figure 7:
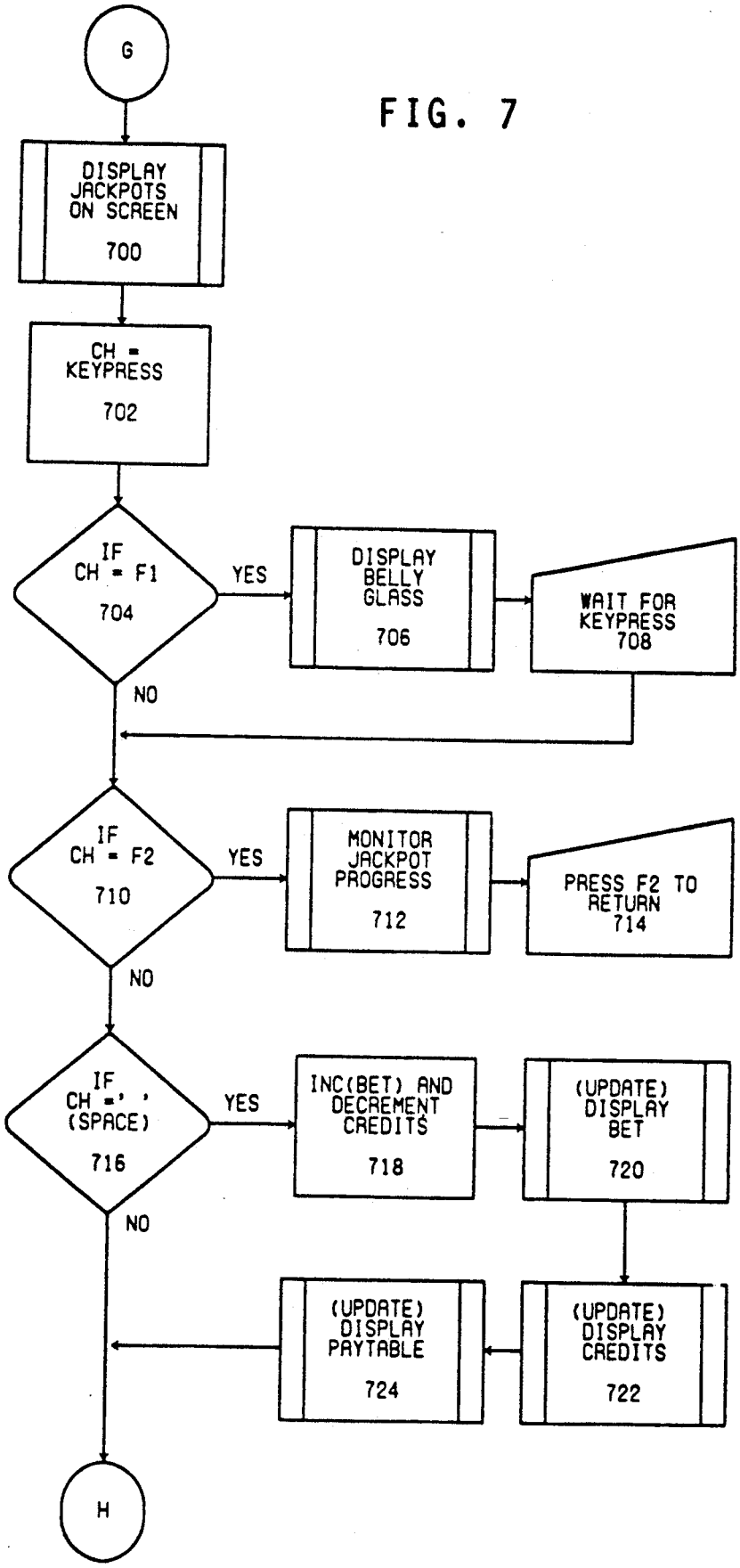
Figure 8:
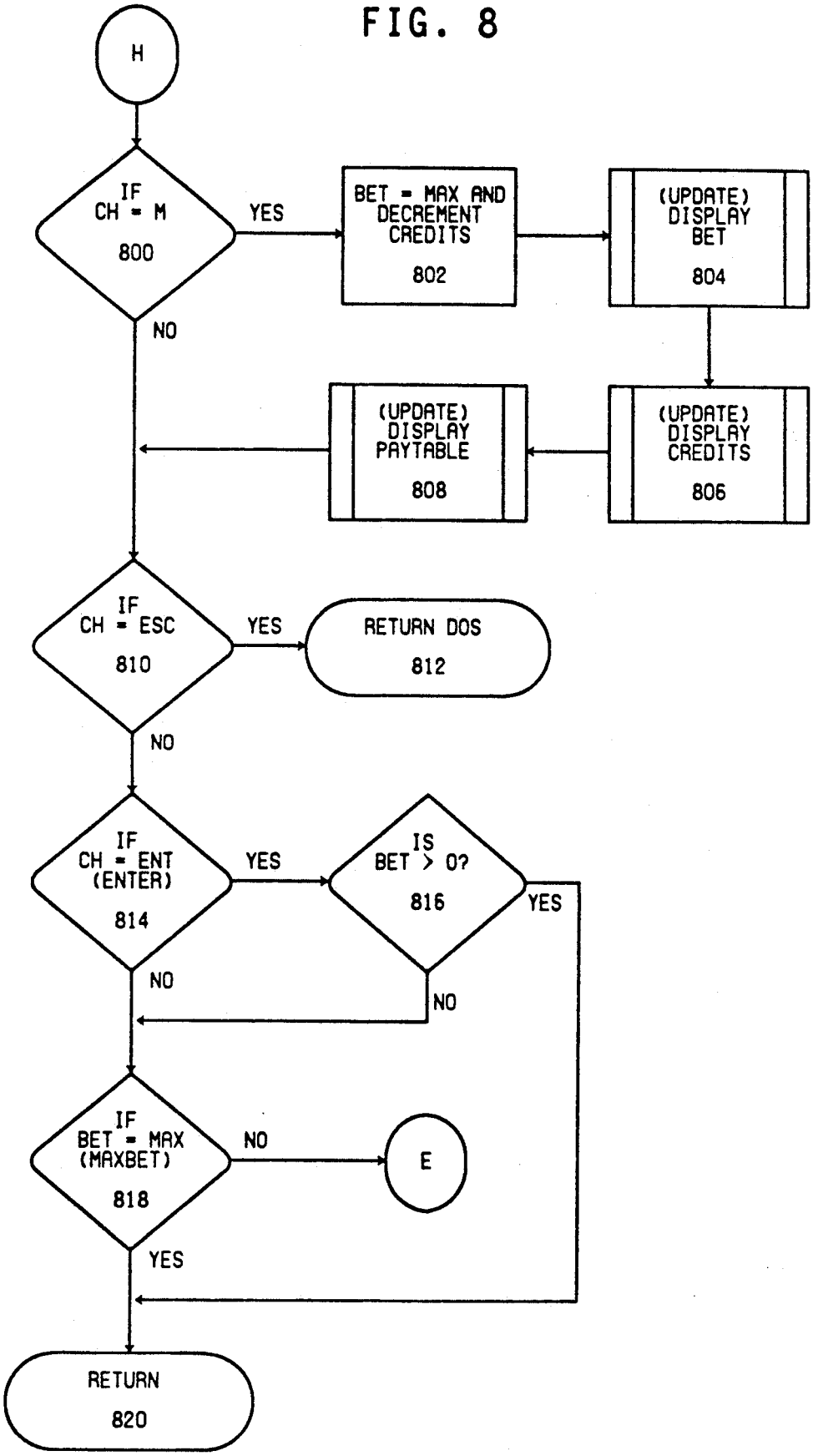
Figure 9:
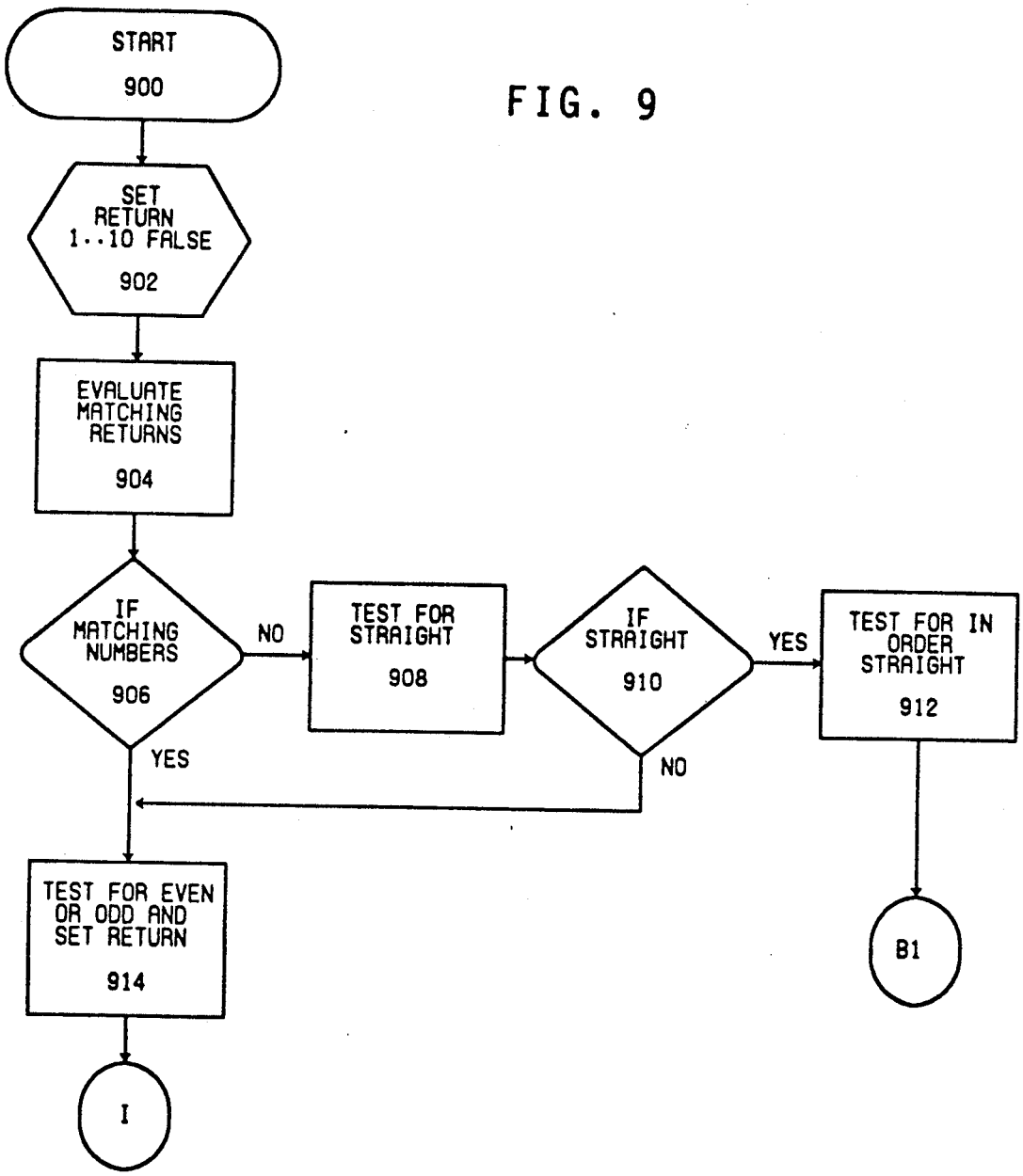

Referring to FIGS. 6–8, sequential steps for receiving a player's bet are illustrated. In accordance with features of the invention, the video lottery gaming device 10 enables a player to view jackpot prize schedules at a block 602 before a wager or bet is entered by the player. A simulated ball draw is run and the jackpot is updated at a block 604 while monitoring for a keypress entry at a block 606 that is identified at decision block 608. The simulated ball draw and jackpot updating is repeated until a keypress entry is identified at block 608. Then following entry point G in FIG. 7, the jackpots are displayed on screen at a block 700. Then one of a plurality of possible player keypress entries is set to CH at block 702 and compared with a plurality of possible player keypress entries at decision blocks 704, 710, 716, and at decision blocks 800, 810, and 814 following entry point G in FIG. 8. When a particular keypress entry is identified, responsive operations are performed as shown in FIGS. 7 and 8, such as updating and displaying bet, credit and paytable parameters. When a bet greater than zero is identified at a decision block 816 or a maximum bet is identified at a decision block 818, then the sequential operations return to entry point B in FIG. 3 to continue the video lottery game. Otherwise, when neither a bet greater than zero is identified at decision block 816 nor a maximum bet is identified at decision block 818, then the operations return to entry point E in FIG. 6 to receive the player's bet.

FIGS. 9 through 16 illustrate the sequential logical steps for evaluating the randomly selected balls beginning at a block 900. Initially, return values are set to false at a block 902. Matching numerical symbols of the balls are identified at a block 904 and include the sequential logical steps shown in FIGS. 12 and 13. The possible matching numerical symbols can include possible winning combinations of five balls of the same numerical symbol, four balls of the same numerical symbol, three balls of the same numerical symbol, three balls of the same first numerical symbol and two balls of the same second numerical symbol, and two balls of the same first numerical symbol and two balls of the same second numerical symbol.

When matching numbers are not identified at a decision block 906, then a test for a predetermined sequence of the identified randomly selected numbers is made at a block 908. When a predetermined sequence is identified at a decision block 910, then a test for an in order sequence including an ascending or descending consecutive numerical symbol sequence is identified at a block 912 as shown in detail in FIGS. 14 and 15. After the in order straight test, the sequential operations end following entry point B1 in FIG. 10. Otherwise, when a straight is not identified at decision block 910 or matching numbers are identified at decision block 906, then a test for even or odd numbers is made and an identified even or odd number return is set at a block 914.

Figure 10:
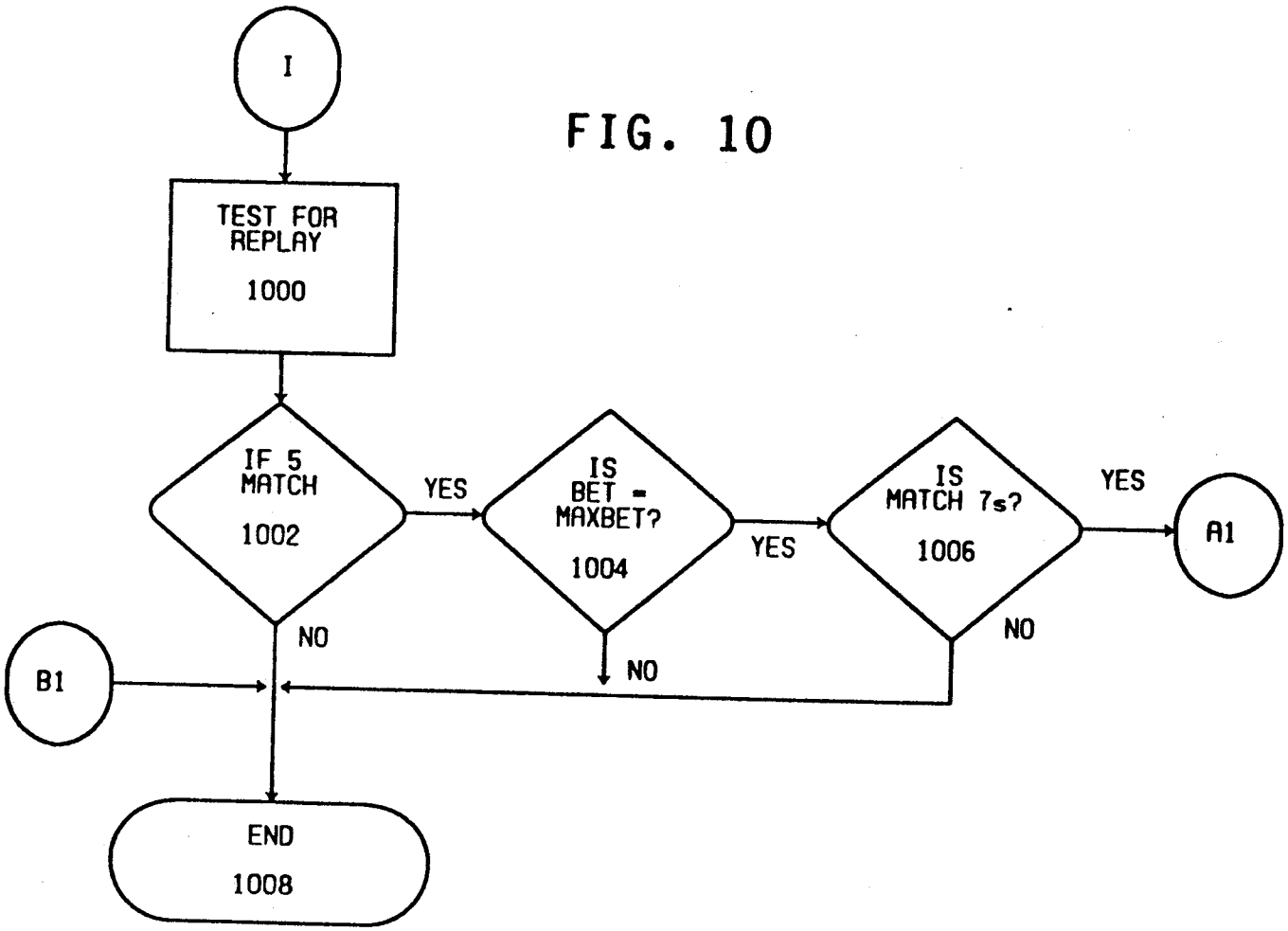
Figure 16:
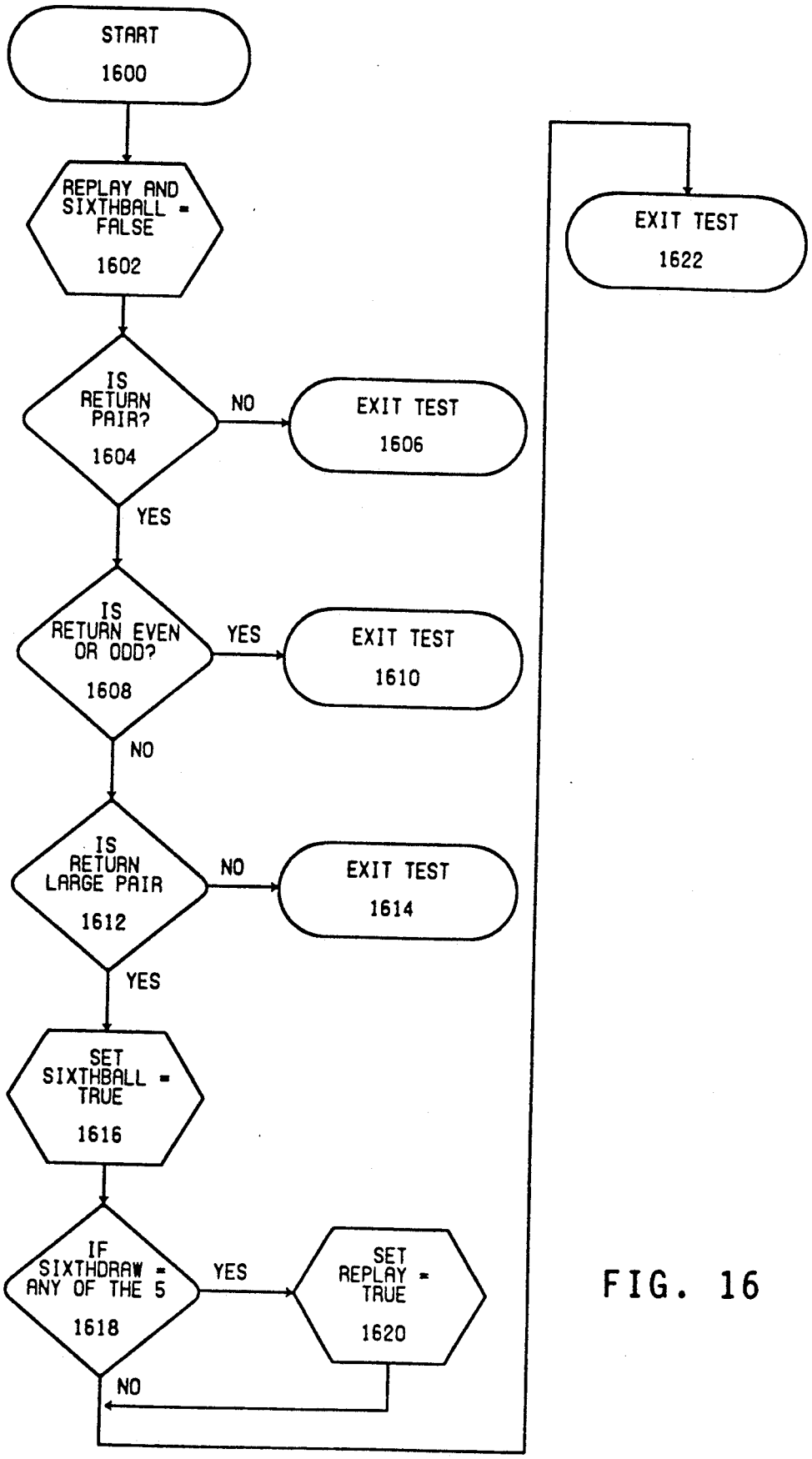

Having reference to FIG. 10, next a test for a replay is made at a block 1000 following an entry point I. Detailed sequential operations for the replay test are illustrated in FIG. 16. Then a five ball matching combination is identified at a decision block 1002 to test for an extra or sixth ball. When a five ball matching combination is not identified at decision block 1002, then the sequential operations end following entry point B1. Otherwise, when a five ball matching combination is identified at decision block 1002, then the bet is checked to determine if the player entered, for example, the maximum bet at a decision block 1004. If a maximum bet is not identified, then the sequential operations end following entry point B1. When, for example, a maximum bet is identified at decision block 1004, then a determination is made of whether the five ball matching combination is a predetermined number, such as a seven at a decision block 1006. If yes, then the sequential operations continue following an entry point A1 in FIG. 11.

Figure 11:
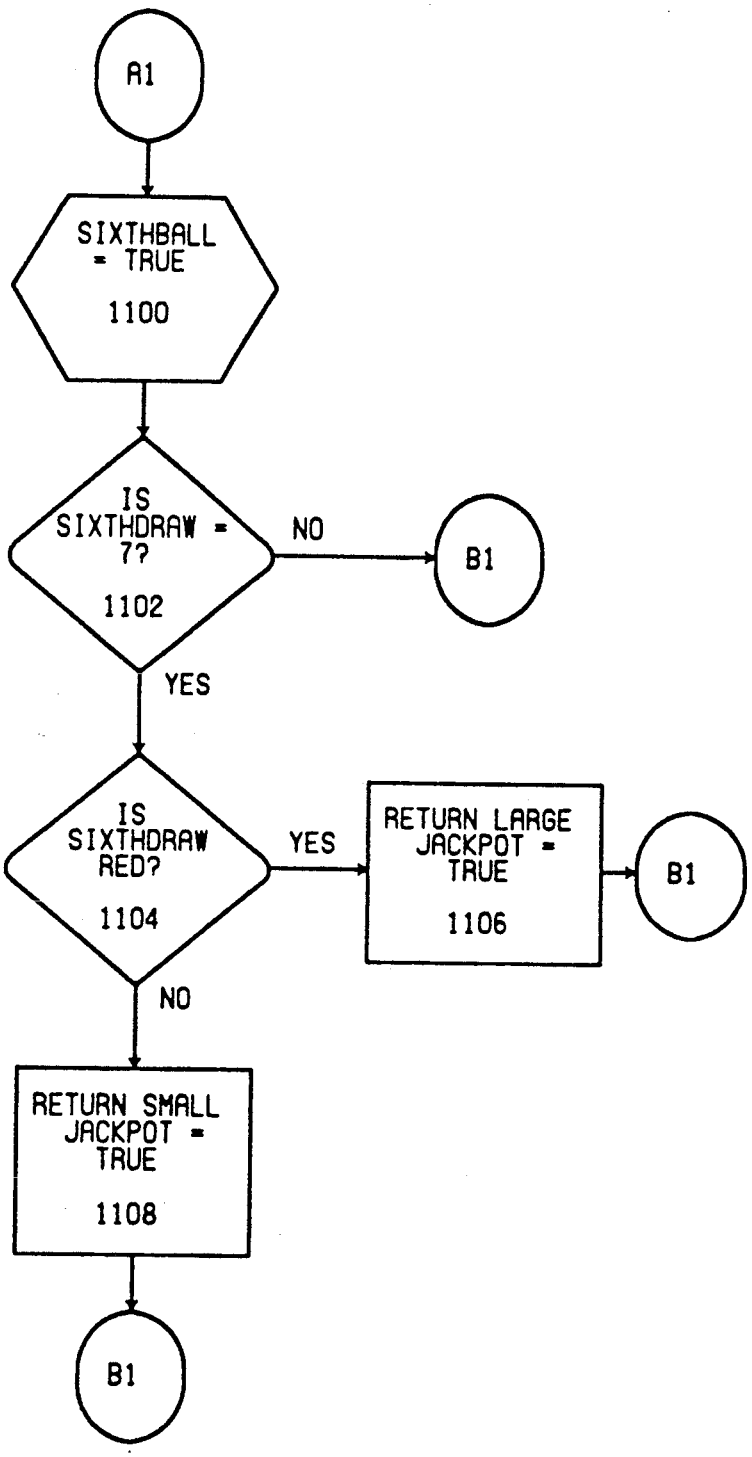
Figure 12:
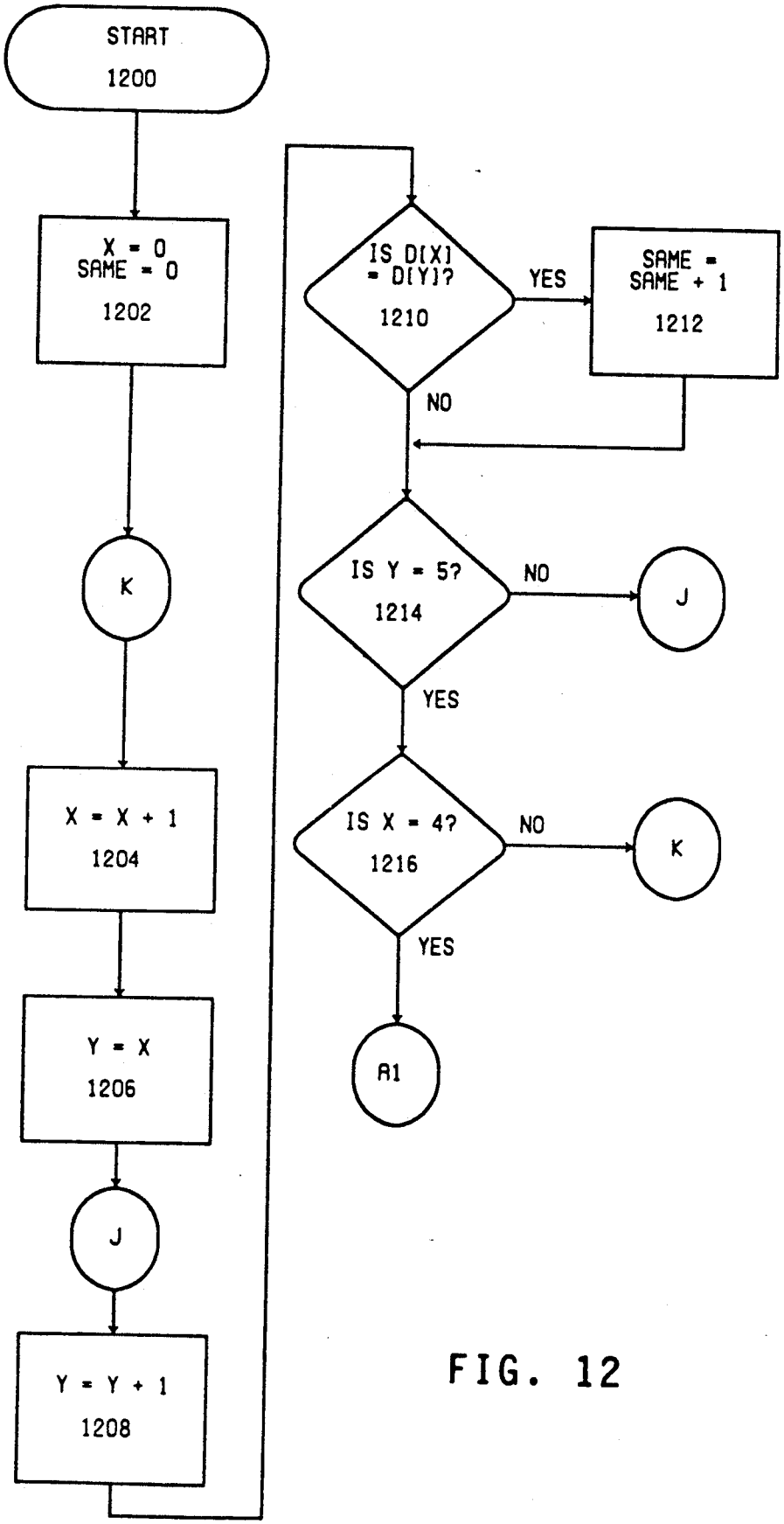
Figure 13:
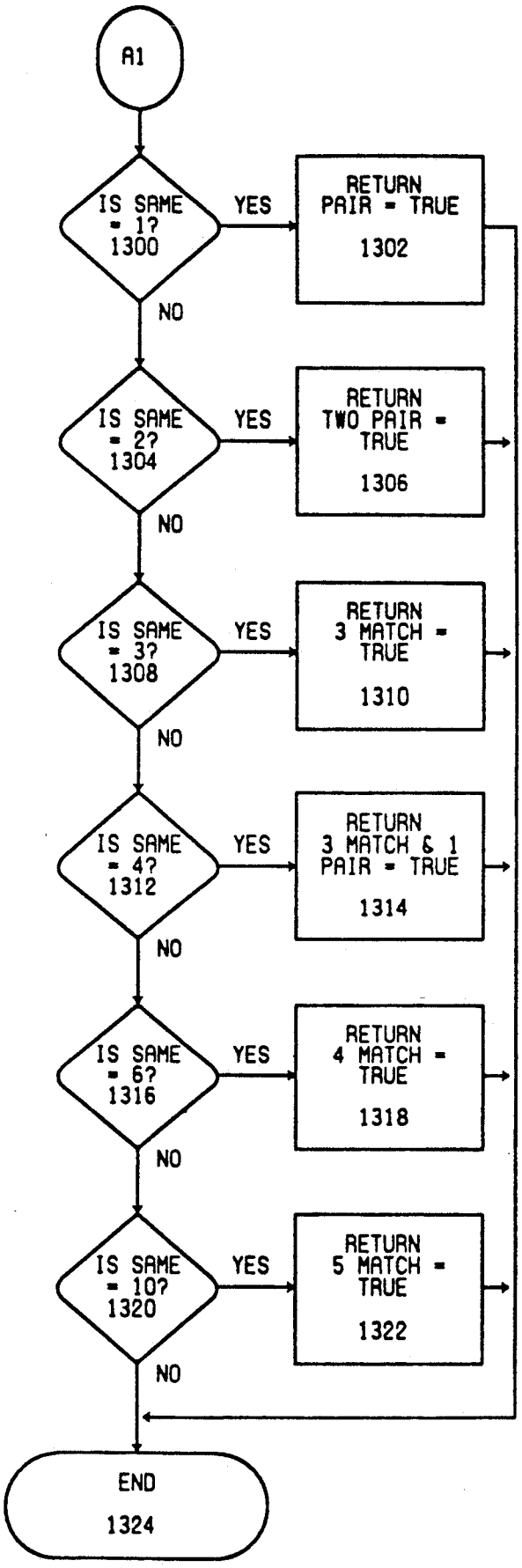
Figure 14:
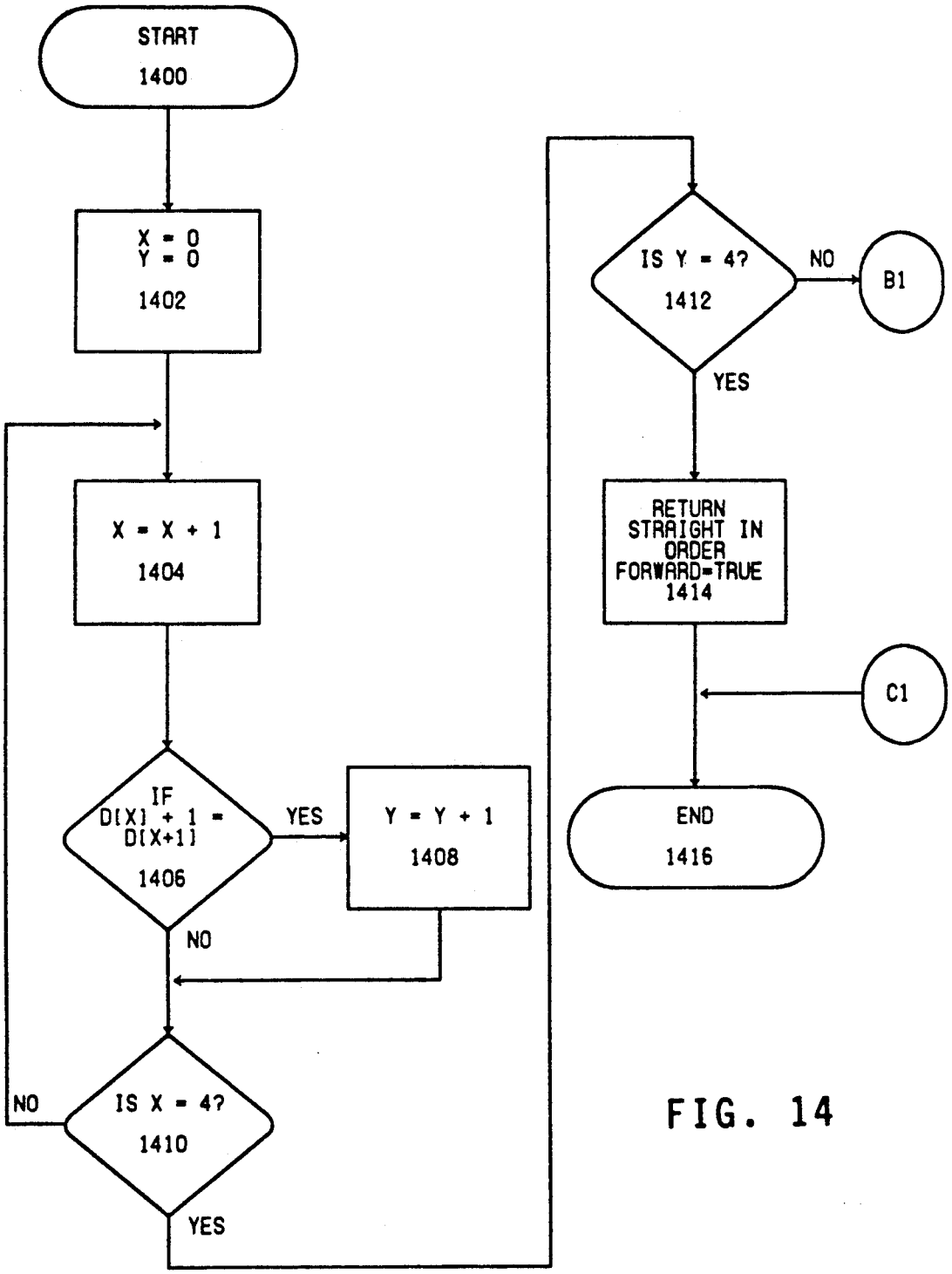
Figure 15:
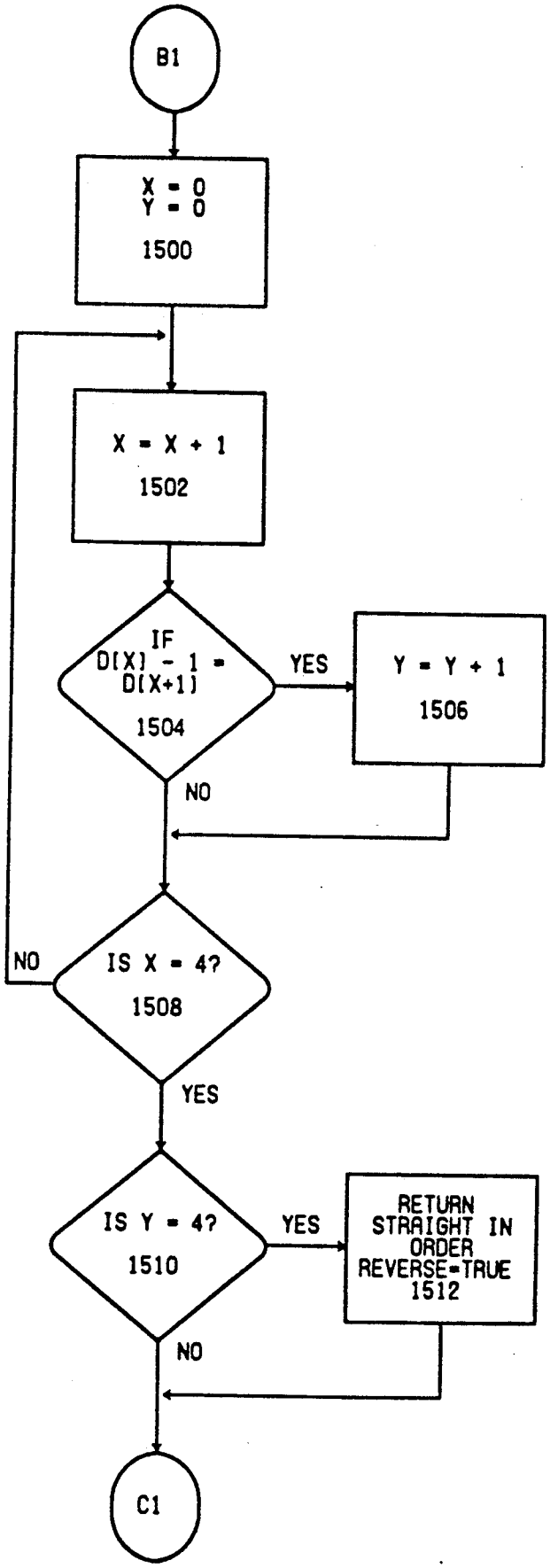
Figure 17:
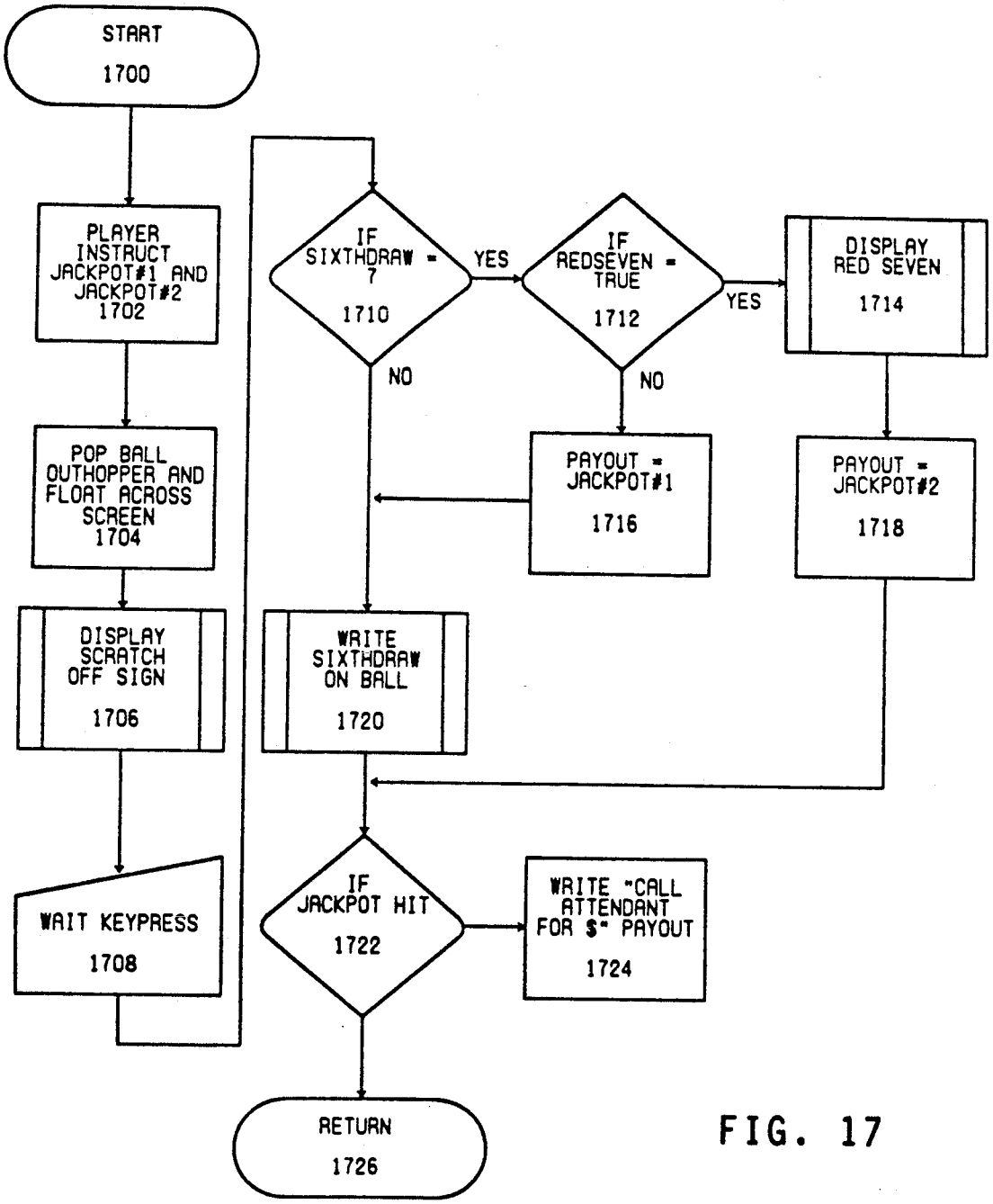
Figure 18:
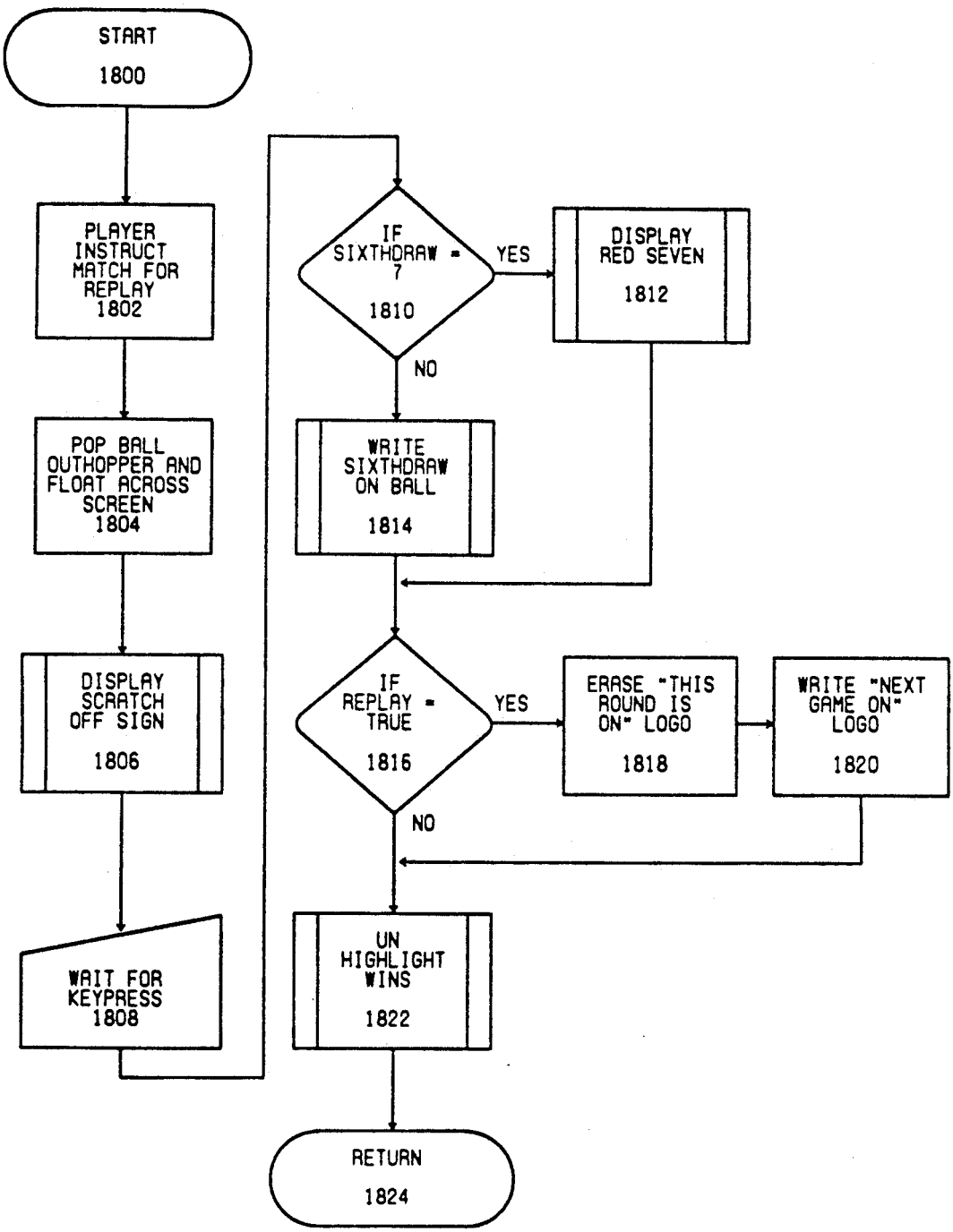
Figure 19:
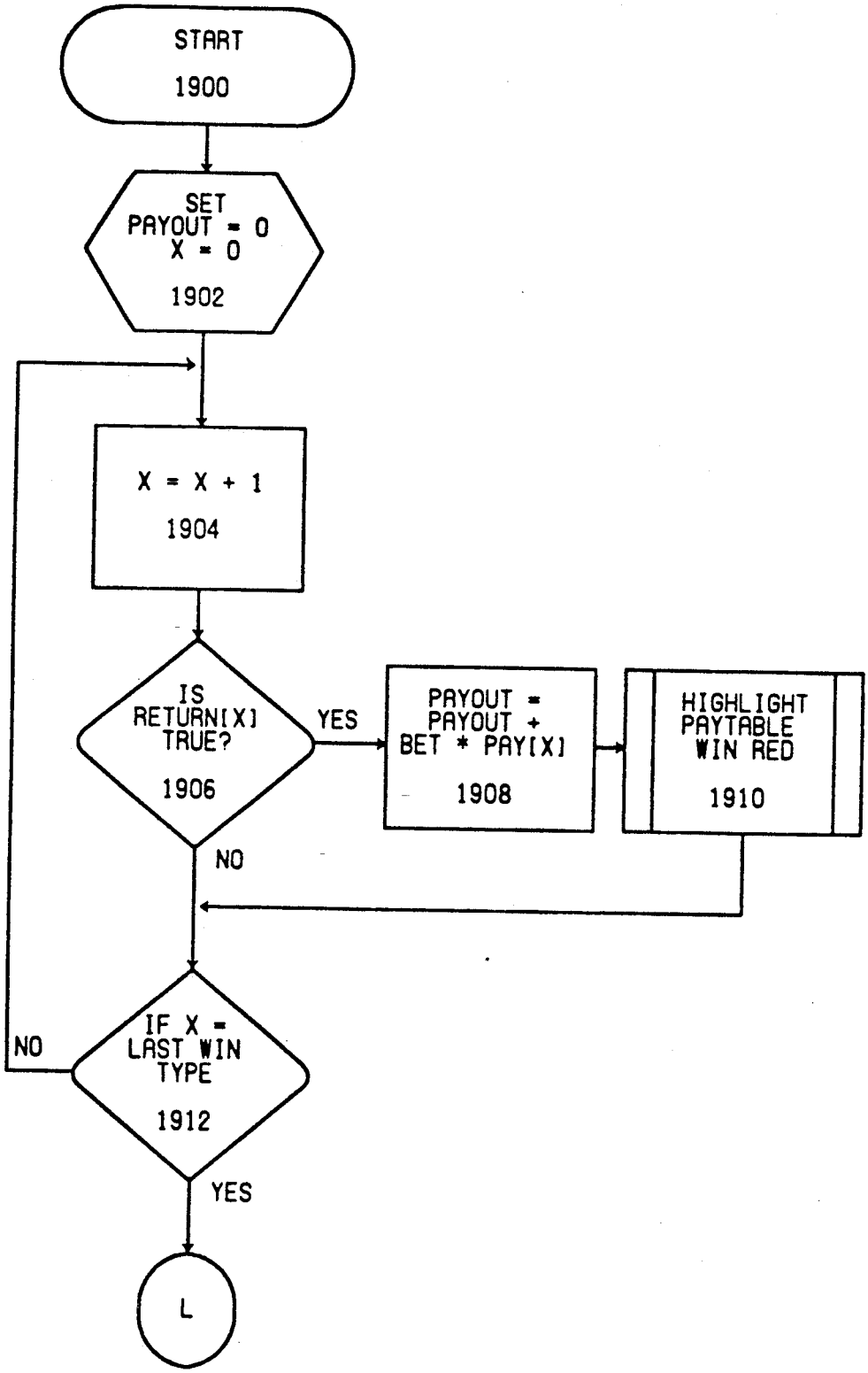
Figure 20:
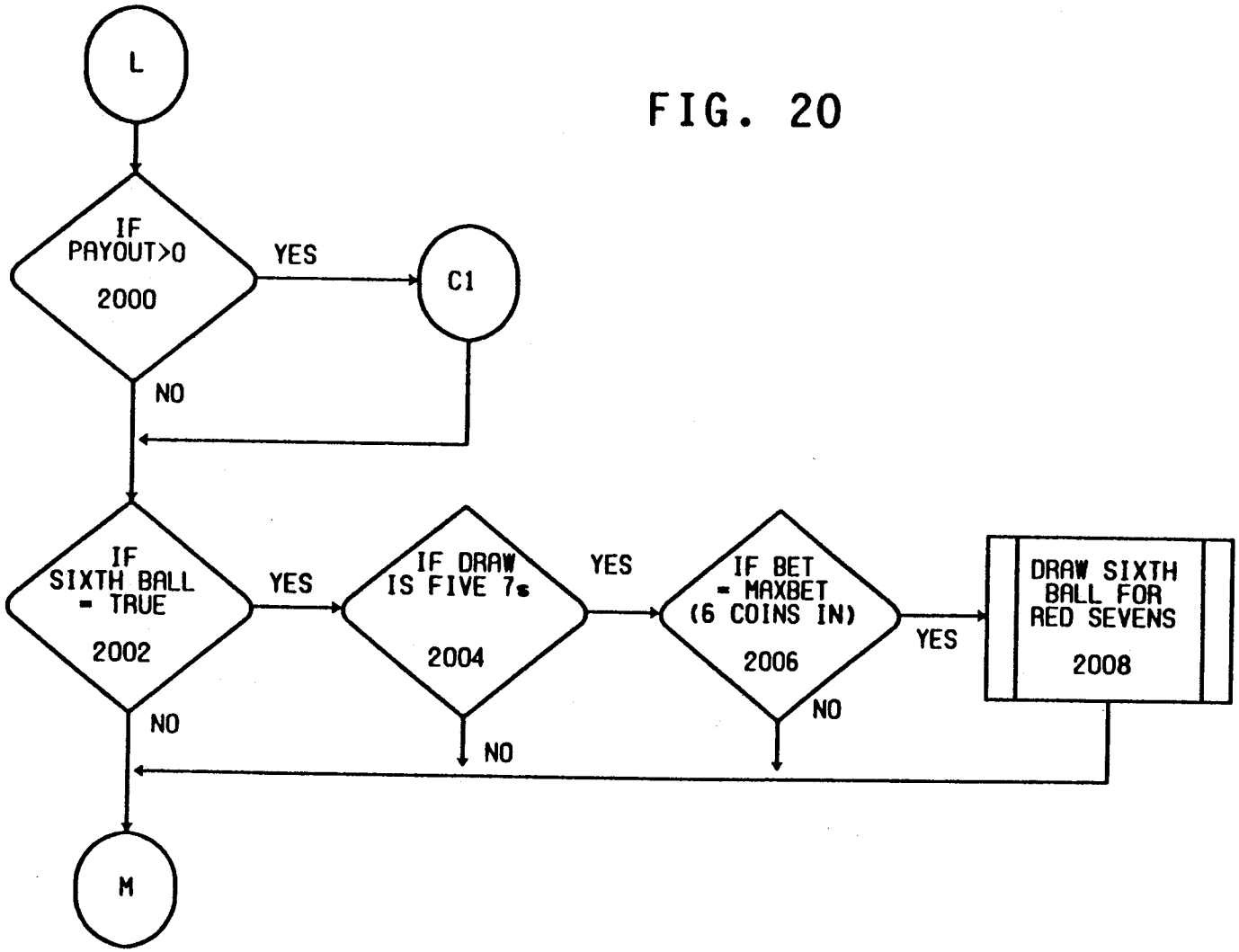
Figure 21:
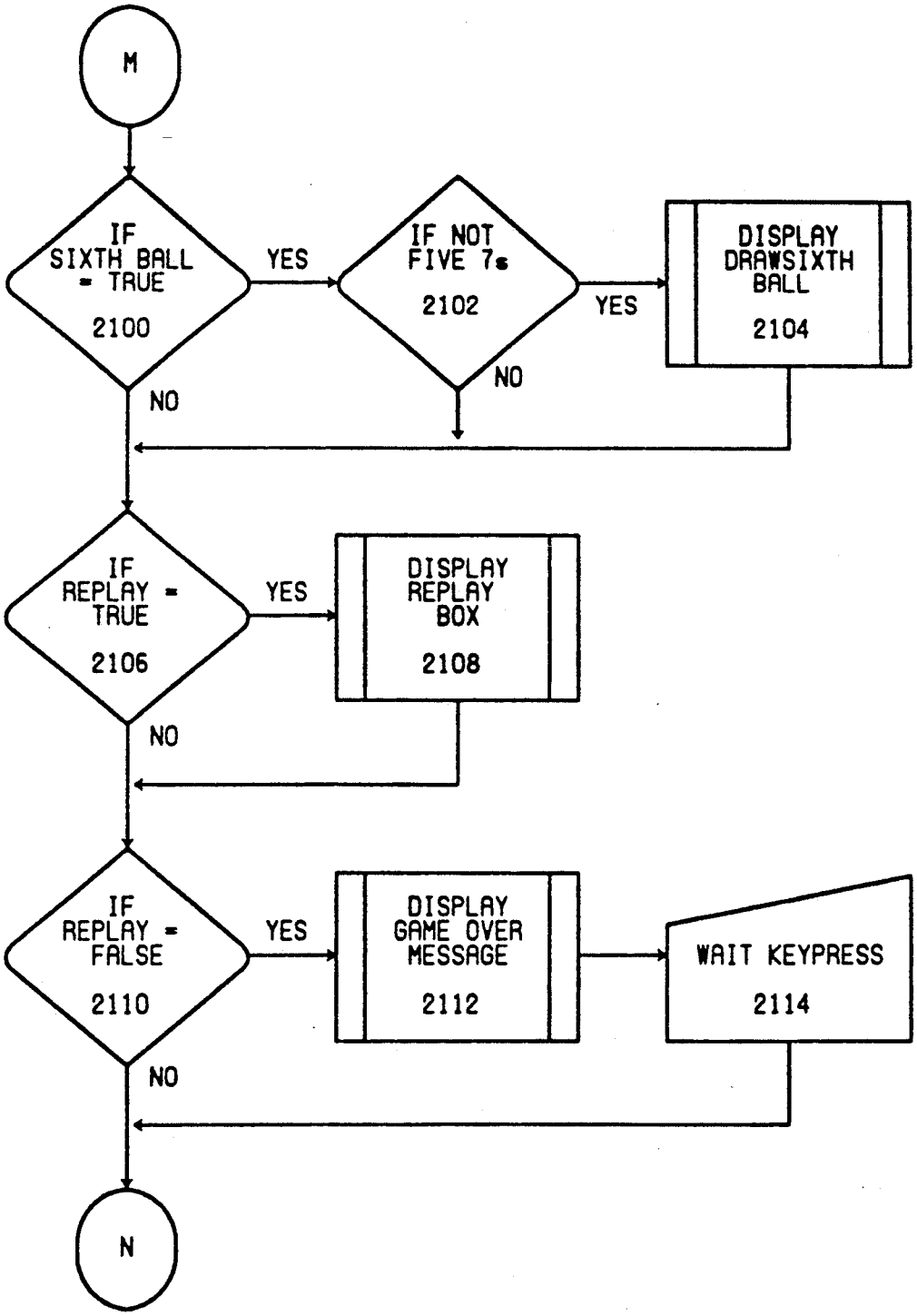
Figure 23:
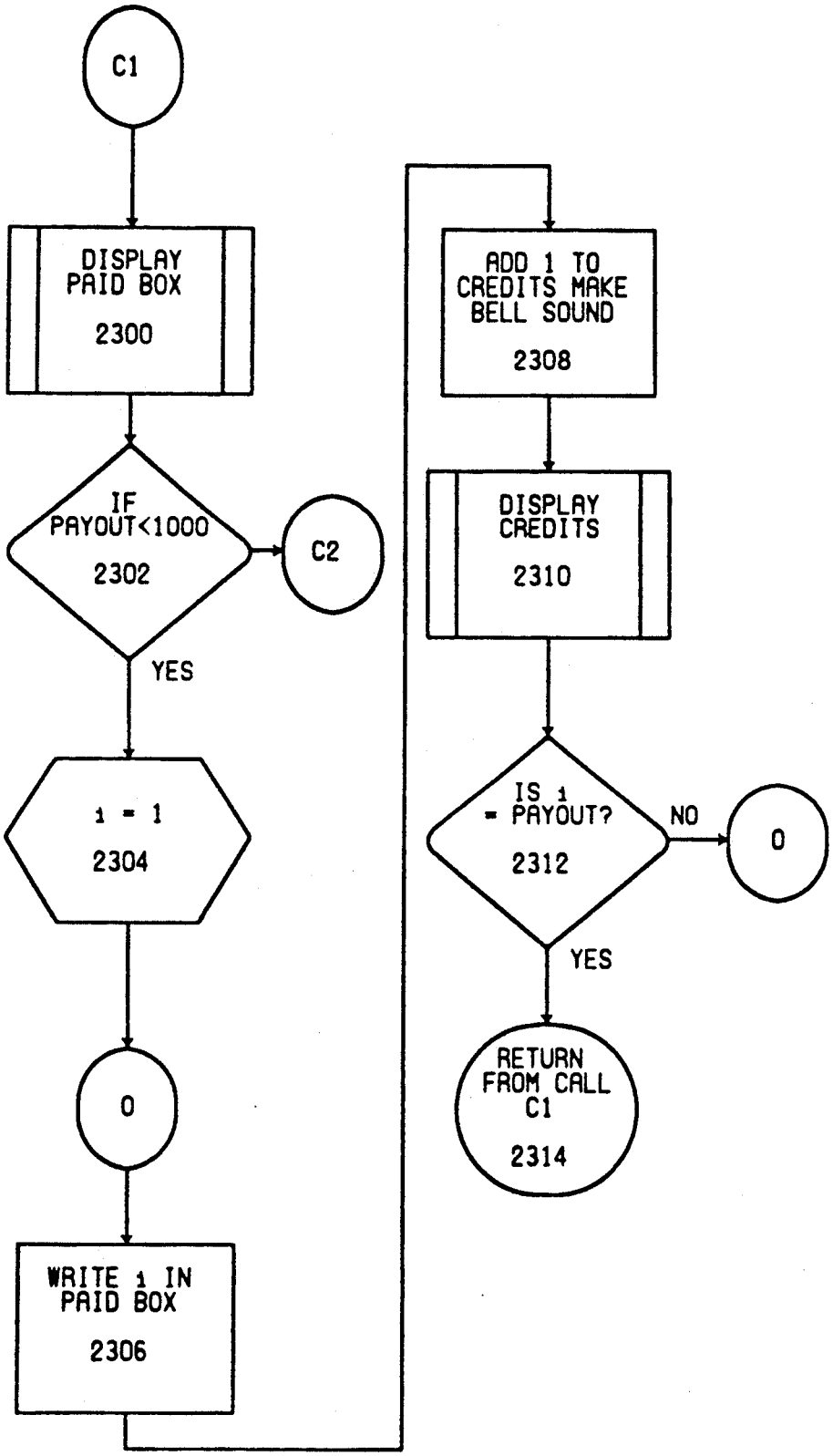
Figure 24:
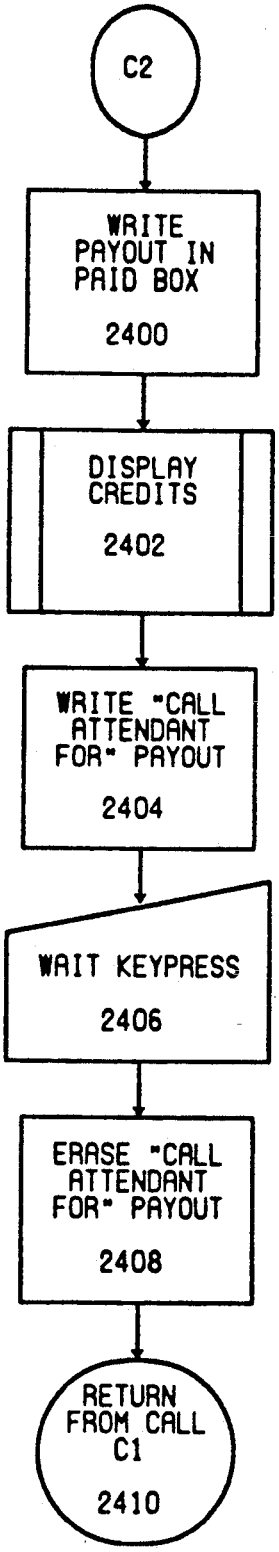

In FIG. 11, the extra or sixth ball is set true at a block 1100. Detailed sequential operations are illustrated in FIG. 17 for a sixth ball draw when there is a chance for the player to win one of the jackpots. Detailed sequential operations for a sixth ball draw are illustrated in FIG. 18 when there is no chance for the player to win one of the jackpots.

Referring again to FIG. 11, next the sixth ball is compared with a seven at a decision block 1102. If not a seven, then the sequential operations end following entry point B1. When the sixth ball is a seven, then the color of the sixth ball is compared to red at a decision block 1104. If red, then the large jackpot is returned true at a block 1106 and the sequential operations end following entry point B1. If not red, then the small jackpot is returned true at a block 1108 and the sequential operations end following entry point B1.

Referring now to FIGS. 19 through 24, detailed sequential operations are illustrated for calculating and displaying game results to make any payoffs to the player. The video lottery game displays jackpot prize schedules including a first progressive jackpot prize amount and a second progressive jackpot prize amount. The first progressive jackpot prize amount is substantially greater than the second progressive jackpot prize amount.

While the invention has been described with reference to details of the illustrated embodiments, these details are not intended to limit the scope of the invention as defined in the appended claims.

What is claimed and desired to be secured by Letters Patent of the U.S. is:

1. A video lottery game having a video display and a processor for enabling a player to play the video lottery game comprising:

means for calculating and displaying jackpot prize schedules including a predetermined paytable; said jackpot prize schedules calculating means being based upon a preselected payback allocation percentage;

player operable means responsive to said displayed jackpot prize schedules for receiving and displaying a bet;

means responsive to said player operable means for receiving and displaying a bet for randomly selecting a plurality of objects;

means for sequentially displaying each of said randomly selected plurality of objects responsive to a player selection;

means responsive to said randomly selected and displayed objects for evaluating and displaying game results, said evaluating means including means responsive to a winning combination of said displayed randomly selected objects for calculating said jackpot prize schedules; and means responsive to said calculated jackpot prize schedules for calculating a payout; said jackpot prize schedules including a first progressive jackpot prize amount and a second progressive jackpot prize amount; said first progressive jackpot prize amount being substantially greater than said second progressive jackpot prize amount; said first progressive jackpot prize amount and said second progressive jackpot prize amount being separately calculated and awarded, whereby a player winning one of said first or second progressive jackpot prize amounts does not affect the amount of the other of said first or second progressive jackpot prize amounts.

2. A video lottery game as recited in claim 1 wherein said player operable means responsive to said displayed jackpot prize schedules for receiving and displaying a bet include player operable means for entering a bet between one and a predetermined maximum integral number.

3. A video lottery game as recited in claim 1 further comprising means for displaying updated jackpot prize schedules responsive to said player operable means for receiving and displaying a bet.

4. A video lottery game as recited in claim 1 wherein said means for randomly selecting and displaying a plurality of objects include a display of five balls, each ball randomly selected from a hopper and each hopper containing balls displaying numerical symbols 0 through 9.

5. A video lottery game as recited in claim 4 wherein each of said balls further displays one of a plurality of predetermined colors.

6. A video lottery game as recited in claim 4 wherein said five ball display including numerical symbols is generated at a speed responsive to a player selection.

7. A video lottery game as recited in claim 1 wherein said means responsive to said randomly selected and displayed objects for evaluating and displaying game results include means for identifying matching numerical symbols of said displayed objects.

8. A video lottery game as recited in claim 1 wherein said means responsive to said randomly selected and displayed objects for evaluating and displaying game results include means for identifying winning combinations responsive to predetermined identified matching numerical symbols including five balls of the same numerical symbol, four balls of the same numerical symbol, three balls of the same numerical symbol, three balls of the same first numerical symbol and two balls of the same second numerical symbol, and two balls of the same first numerical symbol and two balls of the same second numerical symbol.

9. A video lottery game as recited in claim 1 wherein said means responsive to said randomly selected and displayed objects for evaluating and displaying game results include means for identifying an in order straight, said in order straight including an ascending or descending consecutive numerical symbol sequence.

10. A video lottery game as recited in claim 1 wherein said means responsive to said randomly selected and displayed objects for evaluating and displaying game results include means for identifying five even numerical symbols or five odd numerical symbols.

11. A video lottery game as recited in claim 1 wherein said means responsive to said randomly selected and displayed objects for evaluating and displaying game results include means for identifying an extra ball combination of numerical symbols, said extra ball combination including five matching numerical symbols or at least two matching numerical symbols and not a winning combination.

12. A video lottery game as recited in claim 11 wherein said means responsive to said randomly selected and displayed objects for evaluating and displaying game results include means for identifying a free replay combination of numerical symbols, said free replay combination identified when an extra ball matches said matching numerical symbols identified for said extra ball combination.

13. A video lottery game as recited in claim 11 wherein said means responsive to said randomly selected and displayed objects for evaluating and displaying game results include means for sequentially evaluating a numerical symbol and color of said extra ball to determine when a payout results from a first progressive jackpot prize amount or a second progressive jackpot prize amount.

14. A method of playing a video lottery game having a video display and a processor comprising the steps of:

calculating and displaying jackpot prize schedules for viewing by a player including a predetermined paytable; said jackpot prize schedules calculation being based upon a preselected payback allocation percentage;

receiving and displaying a player's bet responsive to said displayed jackpot prize schedules;

randomly selected a plurality of objects;

sequentially displaying each of said randomly selected plurality of objects responsive to a player selection;

evaluating and displaying game results responsive to said randomly selected and displayed objects; and calculating an updated jackpot prize schedule responsive to a predetermined evaluated game result of a winning combination of said randomly selected and displayed objects; said jackpot prize schedules including a first progressive jackpot prize amount and a second progressive jackpot prize amount; said first progressive jackpot prize amount being substantially greater than said second progressive jackpot prize amount; said first progressive jackpot prize amount and said second progressive jackpot prize amount being separately calculated and awarded, whereby a player winning one of said first or second progressive jackpot prize amounts does not effect the amount of the other of said first or second progressive jackpot prize amounts.

* * * * *